US008570232B2

(12) United States Patent
Klos et al.

(10) Patent No.: US 8,570,232 B2
(45) Date of Patent: Oct. 29, 2013

(54) BROADBAND ANTENNA

(75) Inventors: Berthold Klos, Ottobrunn (DE); Dietmar Leugner, Munich (DE); Ludwig Nielsen, Starnberg (DE)

(73) Assignee: Rohde & Schwarz GmbH & Co. KG, Munich (DE)

( * ) Notice: Subject to any disclaimer, the term of this patent is extended or adjusted under 35 U.S.C. 154(b) by 302 days.

(21) Appl. No.: 13/001,394

(22) PCT Filed: Jul. 2, 2009

(86) PCT No.: PCT/EP2009/004788
§ 371 (c)(1),
(2), (4) Date: Mar. 7, 2011

(87) PCT Pub. No.: WO2010/049018
PCT Pub. Date: May 6, 2010

(65) Prior Publication Data

US 2011/0163928 A1 Jul. 7, 2011

(30) Foreign Application Priority Data

Oct. 30, 2008 (DE) ..... 10 2008 053 832
Mar. 31, 2009 (DE) ..... 10 2009 015 699

(51) Int. Cl.
*H01Q 9/16* (2006.01)

(52) U.S. Cl.
USPC ..... 343/791; 343/749

(58) Field of Classification Search
USPC ..... 343/722, 745, 749, 790, 791
See application file for complete search history.

(56) References Cited

U.S. PATENT DOCUMENTS

| | | | | |
|---|---|---|---|---|
| 387,973 | A | 8/1888 | Giles | |
| 3,277,487 | A * | 10/1966 | Berry et al. | 343/722 |
| 3,315,264 | A * | 4/1967 | Brueckmann | 343/791 |
| 3,403,405 | A * | 9/1968 | Barrar et al. | 343/745 |
| 3,680,146 | A | 7/1972 | Leitner | |
| 4,087,823 | A * | 5/1978 | Faigen et al. | 343/791 |
| 6,229,495 | B1 | 5/2001 | Lopez | |
| 6,483,471 | B1 * | 11/2002 | Petros | 343/725 |
| 6,836,256 | B2 * | 12/2004 | Hung | 343/790 |
| 6,919,851 | B2 * | 7/2005 | Rogers et al. | 343/749 |
| 7,289,080 | B1 | 10/2007 | Bohlman | |

FOREIGN PATENT DOCUMENTS

| | | |
|---|---|---|
| DE | 38 26 777 A1 | 2/1990 |
| DE | 199 44 505 C2 | 4/2001 |
| DE | 202 10 083 U1 | 12/2002 |
| DE | 697 15 362 T2 | 4/2003 |

(Continued)

OTHER PUBLICATIONS

English translation of the International Preliminary Report on Patentability mailed May 12, 2011, in corresponding International Patent Application No. PCT/EP2009/004788, filed Jul. 2, 2009.

(Continued)

*Primary Examiner* — Tho G Phan
(74) *Attorney, Agent, or Firm* — Christensen O'Connor Johnson Kindness PLLC

(57) ABSTRACT

An antenna comprises a monopole and a dipole. The dipole provides a first antenna element and a second antenna element, which provide a common longitudinal axis with the longitudinal axis of a monopole. The first antenna element of the dipole is connected to the second antenna element of the dipole and to the monopole. The monopole bears the dipole. The antenna further contains a decoupling element, which is disposed between the monopole and the dipole.

14 Claims, 9 Drawing Sheets

(56) References Cited

FOREIGN PATENT DOCUMENTS

| | | | |
|---|---|---|---|
| DE | 102 35 222 | A1 | 2/2004 |
| EP | 1 569 297 | A1 | 8/2005 |
| JP | 63-42504 | A | 2/1988 |
| WO | 87/00351 | A1 | 1/1987 |
| WO | 01/47057 | A1 | 6/2001 |

OTHER PUBLICATIONS

International Search Report dated Sep. 21, 2009, issued in corresponding International Application No. PCT/EP2009/004788, filed Jul. 2, 2009.

* cited by examiner

BROADBAND ANTENNA

FIELD OF PRESENT DISCLOSURE

The invention relates to a broadband antenna with a monopole and a dipole.

BACKGROUND

Moreover, DE 102 35 222 A1 discloses a broadband antenna with a monopole and a dipole, which are used for different frequency ranges. However, this broadband antenna provides suboptimal directional properties and a suboptimal frequency response. Furthermore, the optical cross-section of this antenna covers a very large area, which excludes it from a large number of applications.

SUMMARY

Embodiments of the present invention are based on the object of providing a broadband antenna, which, with compact dimensions, especially a small width, provides a broadband frequency range.

The object is achieved by the antenna according to embodiments of the present invention with the features of claim 1. Advantageous further developments form the subject matter of the dependent claims referring back to this claim.

An antenna according to embodiments of the present invention comprises a monopole and a dipole. The dipole provides a first antenna element and a second antenna element, which have a common longitudinal axis with the longitudinal axis of the monopole. The antenna further contains a decoupling element, which is arranged between the monopole and the dipole. Accordingly, an advantageous directional characteristic is achieved with a high antenna gain over a broad frequency range.

The first antenna element of the dipole is preferably connected to the second antenna element of the dipole and to the monopole. Accordingly, the monopole preferably bears the dipole.

The monopole is preferably designed at least partially in a tubular manner. The antenna preferably contains a line, which is disposed at least partially within the monopole. The line is preferably connected at a connection point to the dipole. Accordingly, a material-saving structure with advantageous transmission properties can be achieved.

A decoupling element preferably attenuates sheath waves. In this manner, interference is avoided, and the antenna gain is increased. The decoupling element advantageously contains a plurality of ferrite cores. The line is advantageously guided through at least a part of the ferrite cores. Thus, a high sheath waves attenuation can be obtained at a low production expenditure.

The antenna elements of the dipole are preferably designed at least partially in a tubular manner. The connection point of the line to the dipole is preferably disposed on the outside of the first antenna element. Accordingly, an interference-free coupling of the line and the antenna can be achieved.

An earth line is advantageously connected at a connection point to the inside of the first antenna element of the dipole. The earth line is preferably connected at a connection point to the inside of the second antenna element of the dipole. Accordingly, additional signal paths on the inside of the antenna element can be used.

A portion of the inside of the first antenna element limited by the connection point of its inside to the earth line and by its end facing towards the second antenna element advantageously forms a first inductance connected in parallel to the first antenna element of the dipole. A portion of the inside of the second antenna element limited by the connection point of its inside to the earth line and by its end facing towards the first antenna element advantageously forms a second inductance connected in series to the second antenna element of the dipole. The first inductance and the second inductance advantageously form a transformer, which implements an impedance matching. Accordingly, an impedance matching is possible without cost-intensive additional components.

The line preferably tapers in the direction towards its connection point with the dipole. The tapering advantageously achieves an impedance matching. Accordingly, a further impedance matching is possible with low manufacturing costs.

The monopole and the dipole are preferably connected via a diplexer to a common contact point. A simple manufacture with advantageous transmission properties can be achieved in this manner.

At least a part of the monopole is preferably formed as a fold-over element. This guarantees a good robustness of the antenna. The monopole advantageously comprises at least two antenna elements and a loading element. The loading element preferably implements an impedance matching. Accordingly, an optimal impedance matching is also achieved in the monopole with low manufacturing costs.

The loading element preferably comprises at least one ferrite core. The line is preferably guided through the ferrite core. An outer conductor of the line is preferably connected to the ends of the first and second antenna element of the monopole facing towards the loading element. Accordingly, only very low manufacturing costs are incurred for the impedance matching.

The monopole is advantageously disposed on a housing, which contains a filter. The filter preferably allocates signals of a high-frequency range to the dipole and signals of a low frequency range to the monopole. The filter is preferably connected to the line and to the monopole. Accordingly, optimal transmission properties are guaranteed with good stability of the antenna.

The line is advantageously formed at least partially as a stripline on a substrate. The substrate is preferably at least partially disposed in the interior of the antenna. Accordingly, a simple mechanical attachment of the inner conductor in the centre of the antenna is possible.

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

DESCRIPTION OF THE DRAWINGS

Embodiments of the present invention are described by way of example below with reference to the drawings, in which an advantageous exemplary embodiment of the present invention is presented. The drawings are as follows.

DETAILED DESCRIPTION

Initially, the general structure and the general functioning of the antenna according to embodiments of the present invention is explained with reference to FIG. 1. Following this, the structure and functioning of individual details of antennas according to embodiments of the present invention are illustrated on the basis of FIGS. 2-7. Moreover, characteristic curves and directional characteristics of exemplary antennas according to embodiments of the present invention are explained with reference to FIGS. 8-10. In some cases, the presentation and description of identical elements has not been repeated in similar drawings.

Figure 1:
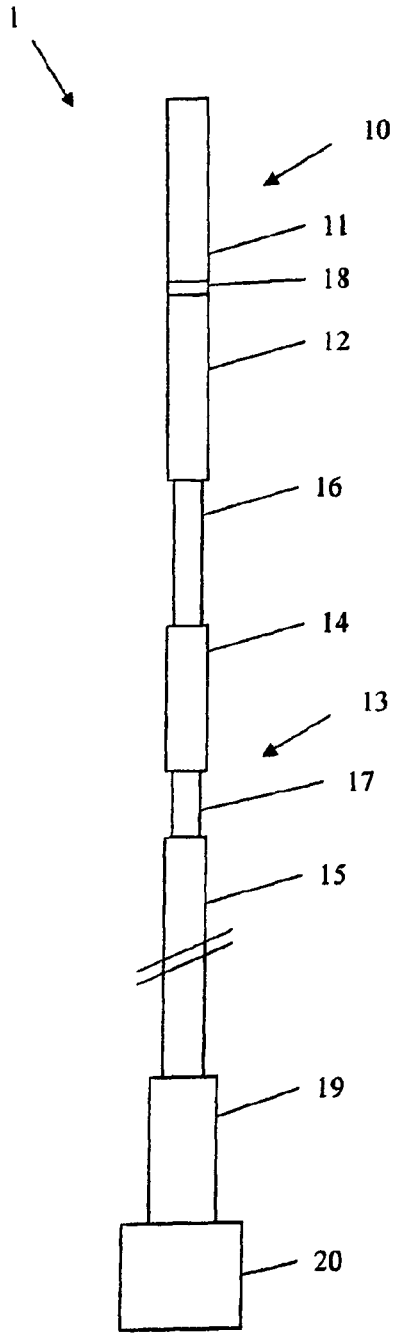
FIG. 1 shows a first exemplary embodiment of the antenna according to aspects of the present invention.

FIG. 1 shows a first exemplary embodiment of the antenna according to embodiments of the present invention. An antenna 1 comprises a monopole 13, a decoupling element 16 and a dipole 10. Furthermore, the antenna 1 contains an antenna base 20. The monopole 13 is mounted on the base 20 and contains a fold-over element 19, a first antenna element 15, a second antenna element 14 and a loading element 17. The fold-over element 19 is designed in this exemplary embodiment as a spiral spring. The antenna elements 14, 15 are hollow tubes made of conducting material.

The fold-over element 19 is connected to the first antenna element 15. The first antenna element 15 is further connected to the loading element 17. Moreover, the latter is connected to the second antenna element 14.

The dipole 10 contains a first antenna element 12, a spacer 18 and a second antenna element 11. In this context, the two antenna elements 11, 12 are connected by the spacer 18. The second antenna element 14 of the monopole 13 is connected to the decoupling element 16. The latter is connected to the first antenna element 12 of the dipole 10.

The monopole 13 and the dipole 10 form respectively independent partial antennas for the different frequency ranges. The separation of the frequency ranges in this context is implemented by means of a filter, especially a diplex filter, which is preferably disposed in the base 20. This filter will be described in greater detail with reference to FIG. 7. The signal supply of the monopole 13 is provided by direct connection to the filter. The signal supply of the dipole is implemented by means of a line extending in the interior of the antenna 1. This will be described in greater detail with reference to FIGS. 3, 4, 5 and 6.

The loading element 17 of the monopole 13 is used in this context for impedance matching. The decoupling element 16 between the dipole and the monopole is used for the attenuation of sheath waves.

Accordingly, the dipole is designed for a high-frequency range from 50 MHz to 2000 MHz, preferably from 150 MHz to 1000 MHz, by particular preference from 200 MHz-600 MHz. The monopole is designed for a low frequency range from 0.1 MHz to 400 MHz, preferably from 10 MHz to 250 MHz, by particular preference from 30 MHz-160 MHz.

The monopole provides a length from 700 mm to 2000 mm, preferably from 1000 mm to 1800 mm, by particular preference of 1600 mm. The dipole provides a length from 200 mm to 600 mm, preferably from 350 mm to 500 mm, by particular preference of 465 mm. The antenna elements of the dipole are largely identical in length. Accordingly, the antenna has a largely uniform diameter from 10 mm to 100 mm, preferably from 20 mm to 40 mm, by particular preference of 28 mm.

Figure 2:
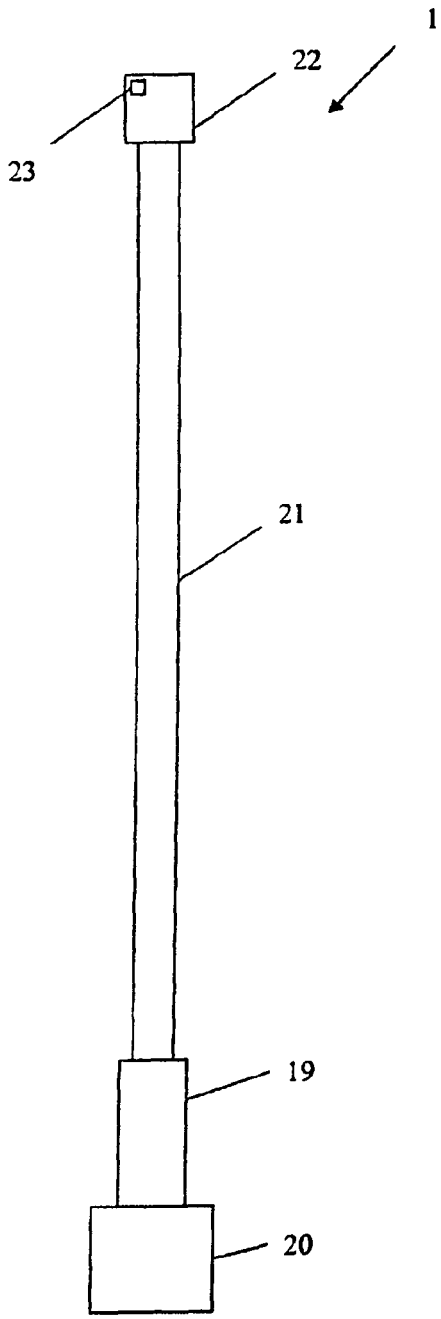
FIG. 2 shows a detail view of the first exemplary embodiment of the antenna according to aspects of the present invention.

FIG. 2 shows a detail of the first exemplary embodiment of the antenna according to embodiments of the present invention. The antenna 1 in this context is at least partially enclosed by a protective sleeve 21. This protective sleeve 21 provides a spacing distance from the components described with reference to FIG. 1. The spacing distance is preferably foam filled in order to increase the mechanical stability. The protective sleeve in this exemplary embodiment is designed as a radome. Furthermore, the upper end of the antenna 1 is provided with a cap 22. The cap 22 is optionally connected to an eye 23, which is used for fastening down the antenna 1 in rough terrain.

Figure 3A:
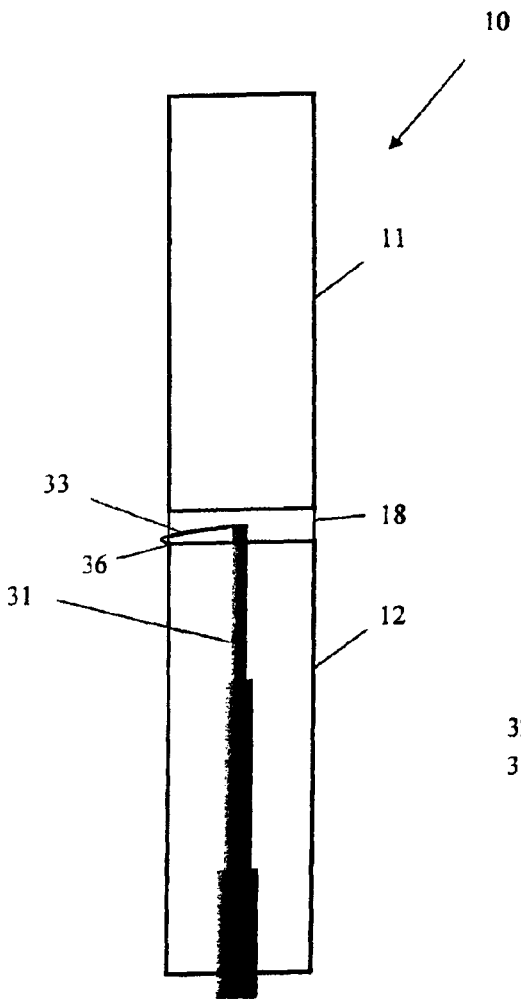
FIG. 3*a* shows a further detail view of the first exemplary embodiment of the antenna according to aspects of the present invention in the cross-section.
Figure 3B:
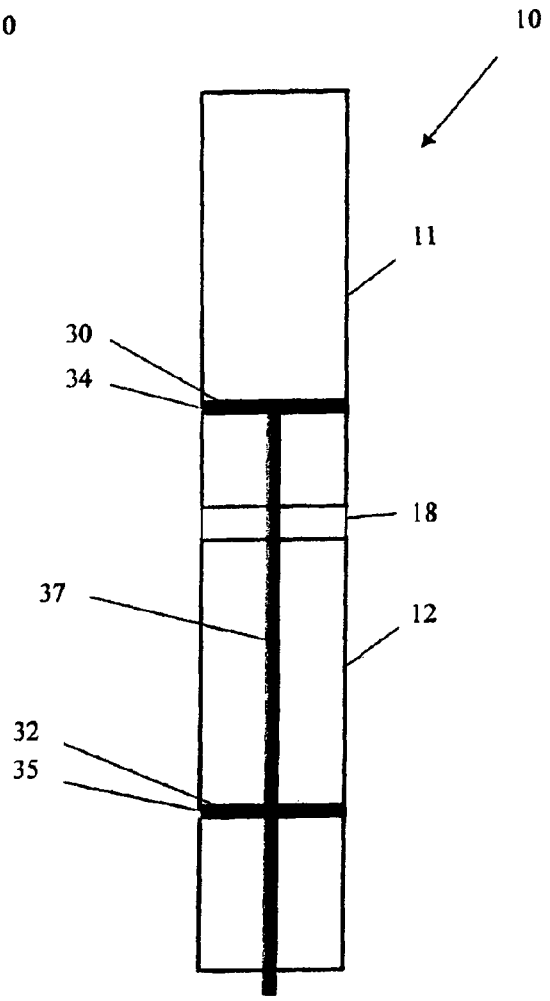
FIG. 3*b* shows a further detail view of the first exemplary embodiment of the antenna according to aspects of the present invention in the cross-section.

In FIGS. 3*a* and FIG. 3*b*, further detail views of the first exemplary embodiment of the antenna according to embodiments of the present invention are illustrated. The dipole 10 comprises the first antenna element 12, the second antenna element 11 and the spacer 18. The antenna elements 11, 12 in this context are designed as hollow tubes. The tubes comprise a conducting material. A printed-circuit board is disposed in the interior of the tubes and is held in position by their internal diameter. FIG. 3*a* shows the front side of the printed-circuit board. FIG. 3*b* shows the rear side of the printed circuit board.

A stripline 31 extends in the interior of the antenna elements 11, 12 on the front side of the printed-circuit board and routes signals from the dipole 10 or routes signals to the dipole 10. The line 31 is connected to the inner conductor of a coaxial line as a supply line. By means of a conducting connection 33, the line 31 is connected at a contact point 36 to the outside of the upper edge of the first antenna element 12.

A line 37 extends on the rear side of the printed circuit board. It is connected to the sheath of the coaxial line as a supply line. The line 37 is connected by means of a conducting connection 32 at a contact point 35 to the inside of the first antenna element 12. The contact point 35 is disposed between the ends of the first antenna element 12. Furthermore, the line 37 is connected by means of a conducting connection 30 at a contact point 34 to the inside of the second antenna element. The contact point 34 is disposed between the ends of the second antenna element 11.

The functioning of the dipole 10 is presented below with reference to a transmitted signal. However, the functioning is reciprocal for a received signal. The signal is transmitted via the lines 31 and 37 to the dipole 10. Via the conducting connection 33, it reaches the outside of the first antenna element 12 and is broadcast from the latter.

Furthermore, via the conducting connection 32 at the contact point 35, the signal reaches the inside of the first antenna coupler 12. However, the inside of the antenna element 12 cannot transmit the signal. The signal runs on the internal surface of the antenna element 12 parallel to the line 31 to the upper edge of the antenna element 12. From there, it reaches the outer surface of the antenna element 12 and is similarly broadcast. The short-circuit by means of the conducting connection 32 acts as a parallel configuration of an inductance, that is to say, an inductance is connected in parallel to the line 37 in the equivalent circuit diagram. Furthermore, the signal runs via the line 37 and the conducting connection 30 at the contact point 34 to the inside of the second antenna element 11 of the dipole 10. From there, it passes via the inside of the second antenna element 11 to its lower edge. From there, it passes to the surface of the second antenna element 11 and is broadcast. There is no direct connection of the line 37 to the surface of the second antenna element 11. In the equivalent circuit diagram, the short-circuit through the conducting connection 30 acts as an inductance connected in series to the line 37. This additional configuration with parallel and serial inductances forms a transformer and is used for matching the impedance.

The line 31 in this exemplary embodiment is not constant in width. Accordingly, the line 31 provides a stepped width. In the lower region, it provides a large width. In the middle region, it provides a medium width. In the upper region, it provides a narrow width. This measure further supports the matching of the impedance of the line 31 to the impedance of the dipole 10.

As an alternative, the line 31 can be designed as a coaxial line. However, especially with a small cross-section, high manufacturing costs are incurred in order to fix the line 31 centrally. The connections between the portions of different cross-sections of the line 31 also require increased manufacturing costs. These problems are resolved by the embodiment of the line 31 as a stripline on a printed-circuit board.

Figure 4:
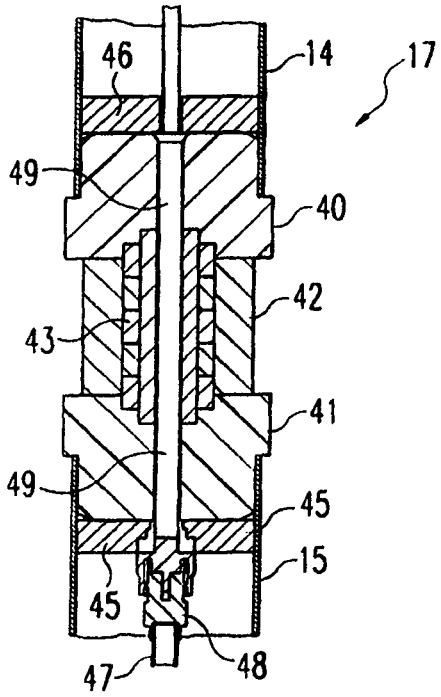
FIG. 4 shows a detail view of a second exemplary embodiment of the antenna according to aspects of the present invention in cross-section.

FIG. 4 shows a detail view of a second exemplary embodiment of the antenna according to embodiments of the present invention. The loading element 17 is connected to the first antenna element 15 and to the second antenna element 14 of the monopole 13. Here, it contains the two connecting washers 45, 46, two spacers 40, 41, a contact 48, a coaxial line 49 and a plurality of ferrite cores 42, 43, 44.

A line 47 extending within the interior of the monopole 13 is connected via the contact 48 through a borehole in the connecting washer 45 to the inner conductor of the coaxial line 49. The sheath line of the coaxial line 49 is connected by means of the connecting washer 45 to the first antenna element 15 of the monopole 13. The coaxial line 49 is guided through a plurality of ferrite cores 42, 43, 44, some of which are disposed one inside the other. In this context, the sheath line of the coaxial line 49 is still connected by means of the connecting washer 46 to the second antenna element 14 of the monopole. The inner conductor of the coaxial line 49 is guided through a borehole in the connecting washer 46. The ferrite cores 42, 43, 44 here are held in position by the spacers 40, 41. The latter are manufactured from a non-conducting material, such as fibre-glass reinforced synthetic material. A conducting connection of the two antenna elements 14, 15 of the monopole 13 is provided only via the sheath line of the coaxial line 49.

The guiding of the coaxial line 49 through the ferrite cores 42, 43, 44 leads to an inductance load per unit length of the coaxial line 49. In the equivalent circuit diagram, this corresponds to the circuit of an inductance, which is connected in parallel to an ohmic resistor, in series with the line 49. This inductance load per unit length supports the matching of the impudence of the line 49.

Figure 5:
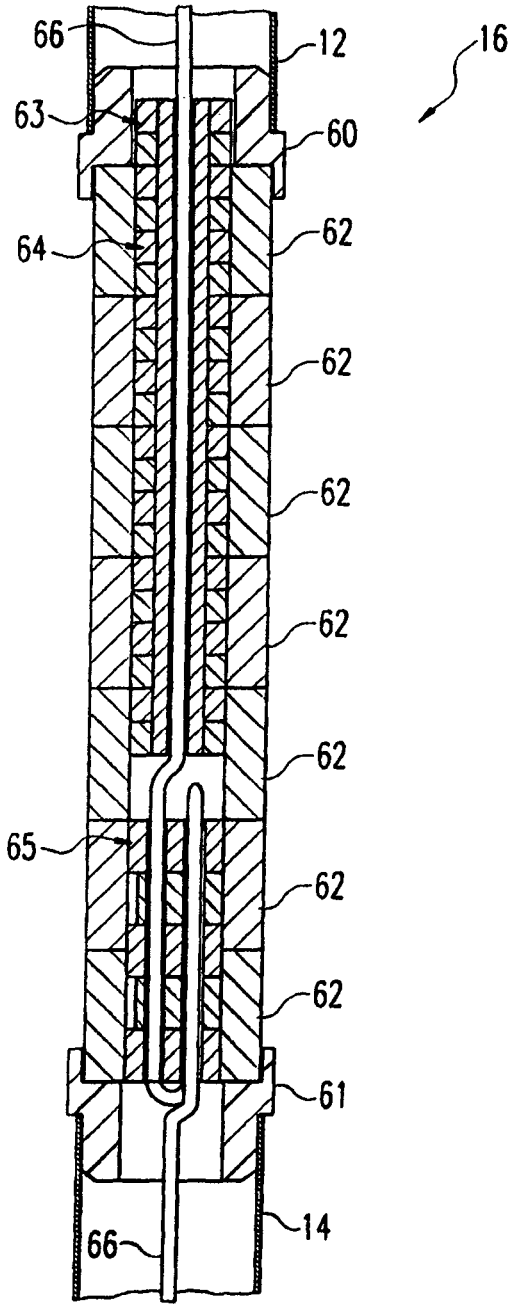
FIG. 5 shows a detail view of the second exemplary embodiment of the antenna according to aspects of the present invention in cross-section.

FIG. 5 shows a further detail view of the second exemplary embodiment of the antenna according to embodiments of the present invention. The decoupling element 16 contains a line 66, a plurality of ferrite cores 62-65 and two spacers 60, 61. The line 66 is a coaxial line. The ferrite cores 65 each provide two through-passages. They are arranged in such a manner, that they are each disposed with one through-passage above the other. The line 66 is guided through these through-passages from the bottom to the top. The second through-passages of a first part of the ferrite cores 65 are also disposed one above the other. The line 66 is guided through these through-passages from the top to the bottom. The second through-passages of a second part of the ferrite cores 65 are also disposed in each case one above the other, however, not above the through-passages of the first part of the ferrite cores. The line 66 is finally guided from the bottom to the top through these through-passages.

Some of the ferrite cores 62-65 are arranged one inside the other. Accordingly, the ferrite cores 63, 64, 65 are arranged within the ferrite cores 62. Furthermore, the ferrite cores 64 are arranged within the ferrite cores 63. The line 66 passes through the ferrite cores 65 and 64 and therefore also through the ferrite cores 63 and 62.

The spacers 60, 61 connect the decoupling element 16 in a non-conducting manner to the second antenna element 14 of the monopole 13 and to the first antenna element 12 of the dipole 10. The passage of the line 66 through the ferrite cores 62-65 brings about a strong attenuation of sheath waves, which are present on the shielding sheath of the line 66. Accordingly, the monopole 13 and the dipole 10 are decoupled from one another. This prevents interference and accordingly stabilises the radiation performance.

Figure 6:
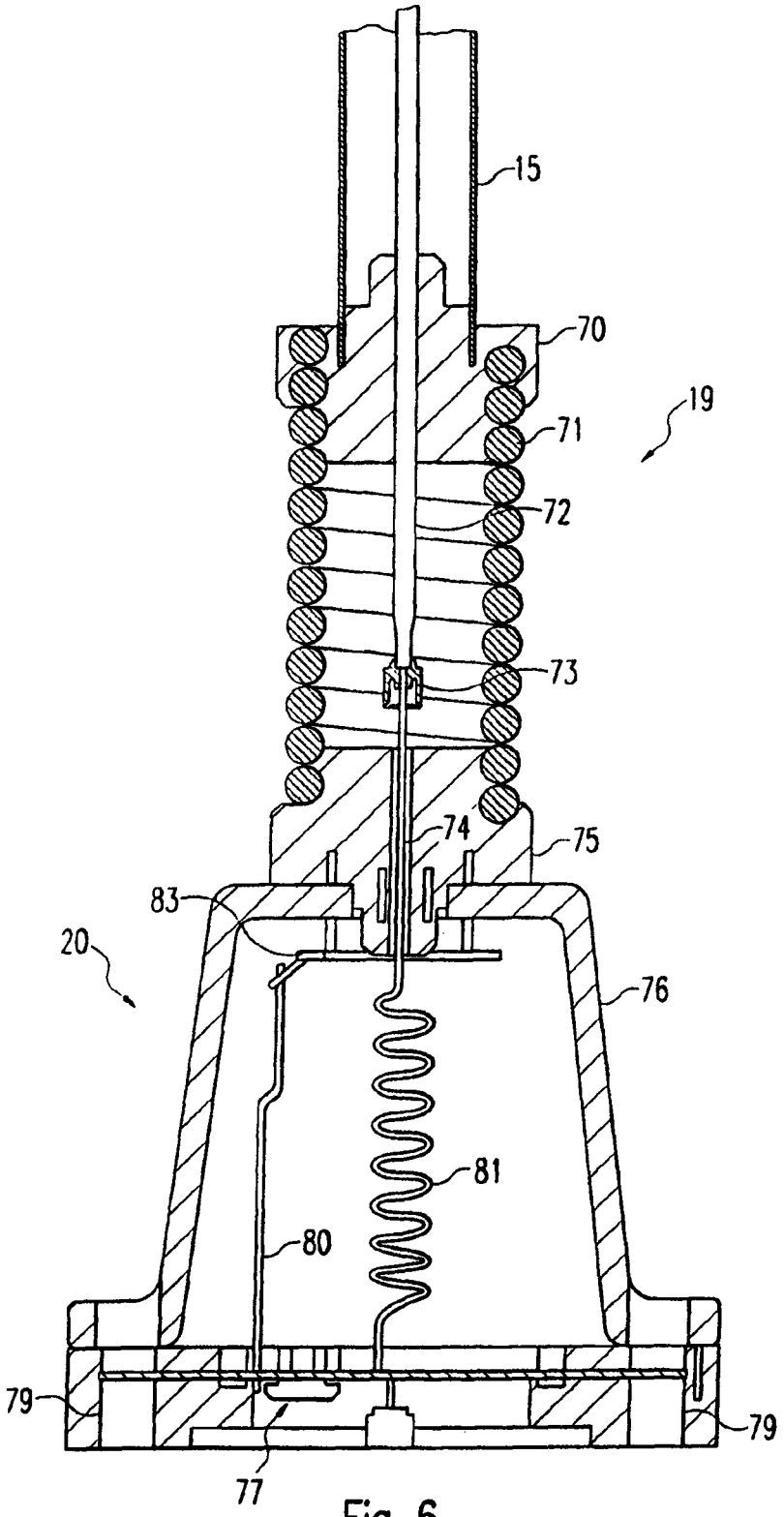
FIG. 6 shows a further detail view of the second exemplary embodiment of the antenna according to aspects of the present invention in cross-section.

FIG. 6 shows a further detail view of the second exemplary embodiment of the antenna according to embodiments of the present invention. As shown in principle with reference to FIG. 1, the monopole 13 contains a first antenna element 15 and a fold-over element 19. The fold-over element 19 provides a first housing element 75, a second housing element 70 and a spring 71. The spring 71 connects the housing elements 70, 75 to one another in a conducting manner. The second housing element 70 is connected in a conducting manner to the first antenna element 15 of the monopole. Both the housing elements 70, 75 and also the spring 71 form a part of the monopole 13.

A line 72 is arranged within the antenna element 15, inside the housing element 70 and inside the spring 71. An optional contact 73 is arranged inside the spring 71. A line 74 is arranged inside the housing element 75 and inside the spring 71. The line 72 is connected by means of the contact 73 to the line 74. The lines 72, 74 here provide a flexibility at least at the level of the flexibility of the spring 71.

The antenna base 20 provides a housing 76, a filter 77, a high-frequency signal contact 82, a first signal line 80, a second signal line 81 and several holding boreholes 79. The base 20 can be attached to a surface by means of the holding boreholes 79. The housing 76 of the base 20 is connected in a non-conducting manner to the housing element 75 of the fold-over element 19. The filter 77 is mounted rigidly inside the housing 76. The high-frequency signal contact 82 is connected to the filter 77. The signal lines 80, 81 are also connected to the filter 77. The first signal line 80 is connected at a contact point 83 to the first housing element 75. The second signal line 81 is connected to the line 74. The second signal line 81 here comprises a wire wound to form a coil.

The function is presented below with reference to an exemplary signal to be transmitted. A signal to be transmitted is broadcast via the high-frequency signal contact 82 to the filter 77. The filter 77 separates the signal to be transmitted into a high-frequency partial signal and into a low-frequency partial signal. The low-frequency partial signal is transmitted via the first signal line 80 to the contact point 83 through a borehole in the housing 76 of the filter 77 to the housing element 75. A conducting connection to the housing 76 of the base 20 is not provided in this context. The housing element 75 is a part of the monopole 13. From the housing element 75, the signal is transmitted to the spring 71, the second housing element 70 and the rest of the monopole 13, from where it is broadcast.

The high-frequency partial signal is transmitted by means of the second signal line 81 to the line 74, which is guided through a borehole in the housing element 75. This line 74 communicates the signal to the dipole 10, which broadcasts the signal.

Figure 7:
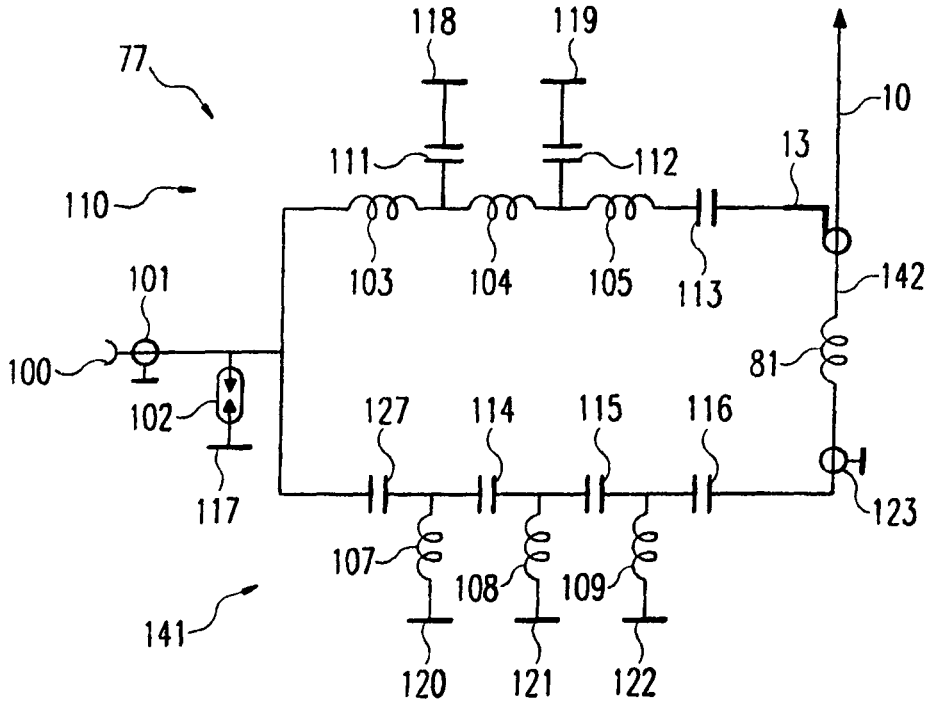
FIG. 7 shows a circuit diagram of a matching network and filter of the second exemplary embodiment of the antenna according to aspects of the present invention.

FIG. 7 shows a circuit diagram of an exemplary embodiment of the matching network and filter of the antenna according to embodiments of the present invention. The filter 77 is presented in greater detail here. The filter 77 is preferably a diplexer circuit. In this exemplary embodiment also, the function is presented with reference to a signal to be transmitted. The function in reception mode is reciprocal. A signal to be transmitted is fed in via a signal contact 100. A shielding sheath of a line, by means of which the signal is connected to the signal contact 100, is connected to the earth contact 101. Overloads, especially through lightning strike, are deflected via a surge protector 102 to the earth contact 117. The signal is now divided between two signal paths 140, 141.

The first signal path 140 comprises a series circuit of several inductances 103, 104, 105 and a coupling capacitor 113, and a parallel circuit of several capacitors 111, 112 to the earth contacts 118, 119. This branch of the filter circuit strongly attenuates high-frequencies, while it attenuates low frequencies only slightly. The first signal path 140 is connected to the monopole 13.

The second signal path 141 comprises a series circuit of several capacitors 114, 115, 127 and a coupling capacitor 116, and a parallel circuit of several inductances 107, 108, 109 to the earth contacts 120, 121, 122. This branch of the filter circuit strongly attenuates low frequencies, while it attenuates high frequencies only slightly. The second signal path 141 is connected via a shielded line to the choke coil 81. In this context, the shield is connected to the earth contact 123. The connection to the dipole 10 is implemented by means of the line 142. The line 142 here extends through the monopole 13.

Figure 8:
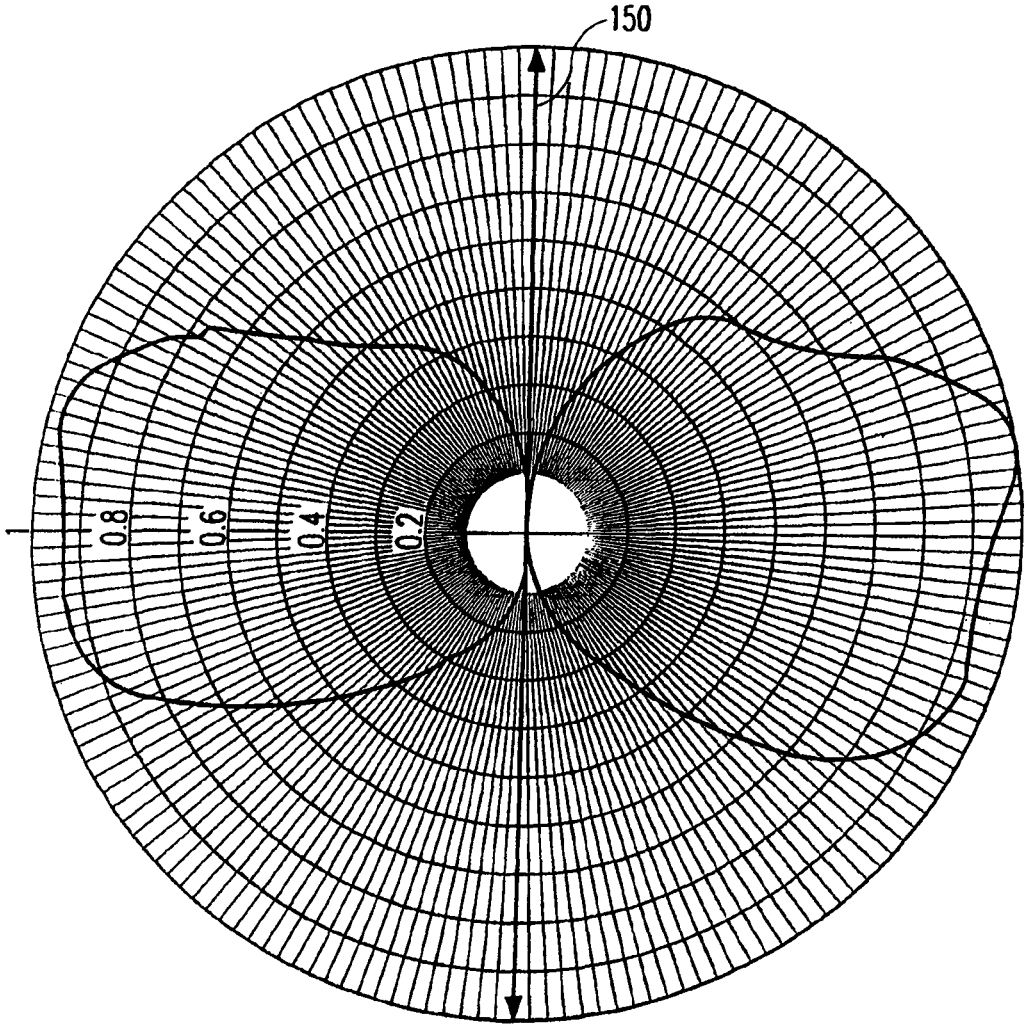
FIG. 8 shows a first diagram of the directional effect of an exemplary antenna according to aspects of the present invention.

FIG. 8 shows a first diagram of the directional effect of an antenna according to embodiments of the present invention in the second exemplary embodiment. The horizontal directional characteristic is presented with a frequency of 250 MHz. That is to say, the antenna is disposed in the centre of the illustration and is orientated in the direction of the axis 150. The strong directional effect in the horizontal direction is clearly recognisable.

Figure 9:
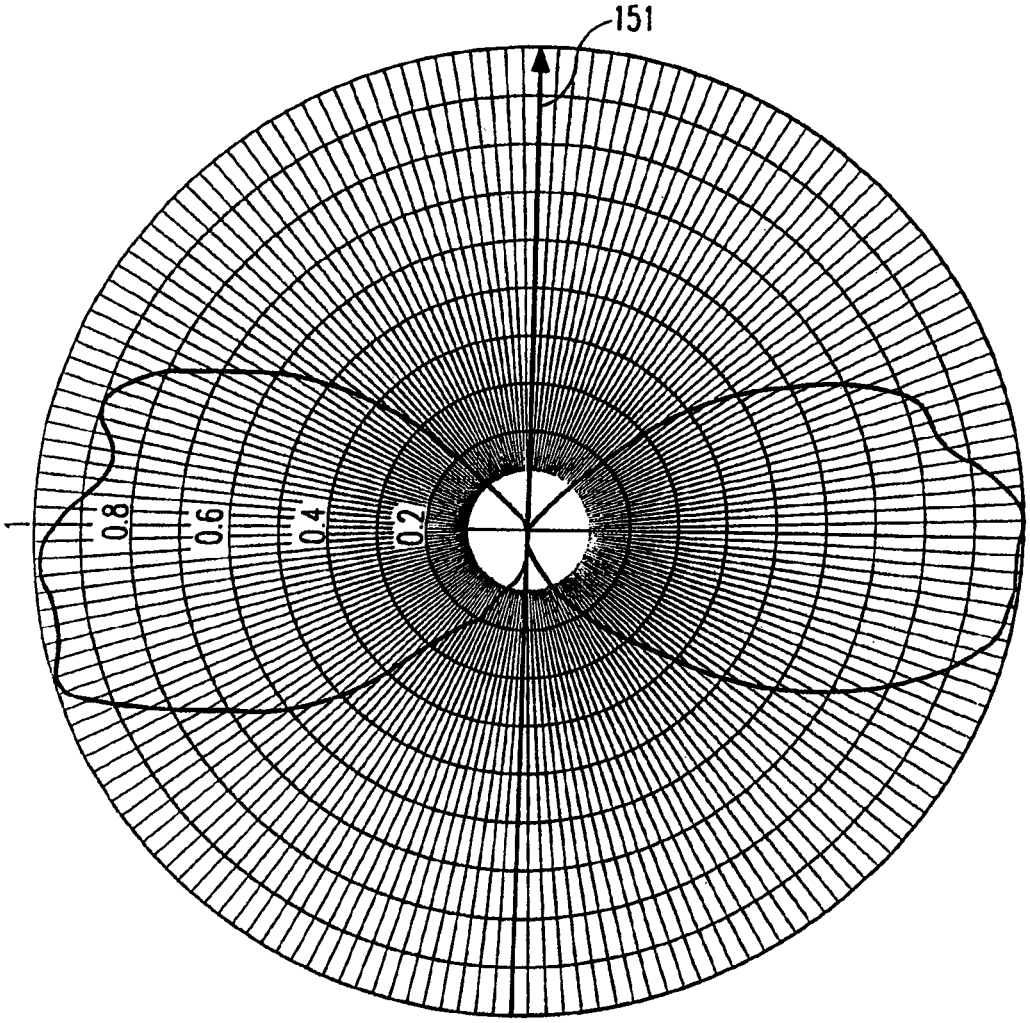
FIG. 9 shows a second diagram of the directional effect of an exemplary antenna according to aspects of the present invention; an FIG. 10 shows antenna gain characteristics of an exemplary antenna according to aspects of the present invention.

FIG. 9 shows a second diagram of the directional effect of an antenna according to embodiments of the present invention in the second exemplary embodiment. The horizontal directional characteristic is presented with a frequency of 550 MHz. The antenna is disposed in the centre of the illustration and is orientated in the direction towards the axis 151. The strong directional effect in the horizontal direction is clearly recognisable. This is more strongly pronounced than at 250 MHz as illustrated in FIG. 8.

Figure 10:
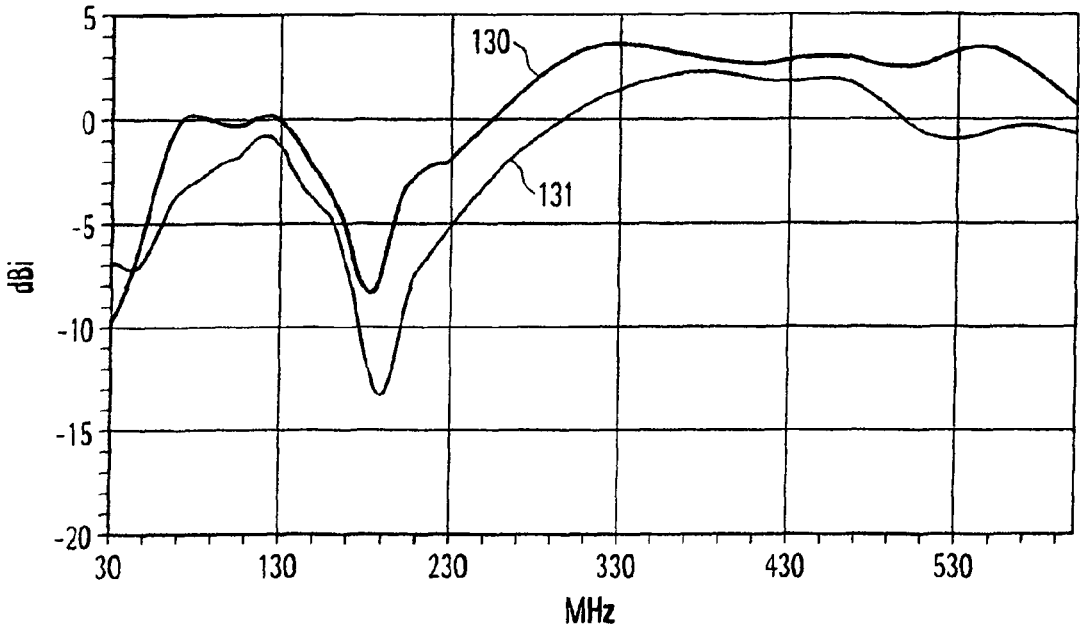

FIG. 10 shows antenna-gain characteristics of an exemplary antenna according to embodiments of the present invention. The antenna gain of an antenna according to embodiments of the present invention is shown with a first characteristic 130, and the antenna gain of an antenna corresponding to the prior art with a second characteristic 131. It is evident that the antenna according to embodiments of the present invention achieves a higher antenna gain in almost the entire frequency range considered than the antenna according to DE 102 35 222 A1 associated with the prior art.

Embodiments of the present invention are not restricted to the exemplary embodiment presented. A use of different dimensions of the antenna and its individual elements is also conceivable, as is the use of alternative elements for impedance matching. An expansion to a broader frequency range is also conceivable. All of the features described above or illustrated in the drawings can be combined with one another advantageously within the framework of embodiments of the present invention as required.

The invention claimed is:

1. An antenna comprising:

a monopole comprising at least two antenna elements and a loading element, the loading element configured to implement an impedance matching;

a dipole comprising a first antenna element and a second antenna element, which provide a common longitudinal axis with the longitudinal axis of the monopole; and a decoupling element disposed between the monopole and the dipole.

2. The antenna according to claim 1, wherein the first antenna element of the dipole is connected to the second antenna element of the dipole and to the monopole and the monopole bears the dipole.

3. The antenna according to claim 1, wherein the monopole is designed at least partially in a tubular form, the antenna contains a line, the line is disposed at least partially within the monopole, and the line is connected at a connection point to the dipole.

4. The antenna according to claim 3, wherein the decoupling element attenuates sheath waves.

5. The antenna according to claim 3, wherein the decoupling element contains a plurality of ferrite cores and the line is guided through at least a part of the ferrite cores.

6. The antenna according to claim 3, wherein the antenna element of the dipole is designed at least partially in a tubular manner and the connection point of the line to the dipole is disposed on the outside of the first antenna element.

7. The antenna according to claim 3, wherein an earth line is connected at a connection point to the inside of the first antenna element of the dipole and the earth line is connected at a connection point to the inside of the second antenna element of the dipole.

8. The antenna according to claim 7, wherein a portion of the inside of the first antenna element limited by the connection point of its inside with the earth line and by its end facing towards the second antenna element forms a first inductance connected in parallel to the first antenna element of the dipole, a portion of the inside of the second antenna element limited by the connection point of its inside with the earth line and by its end facing towards the first antenna element forms a second inductance connected in series to the second antenna element of the dipole, the first inductance and the second inductance form a transformer, and the transformer implements an impedance matching.

9. The antenna according to claim 3, wherein the line tapers in the direction towards its connection point with the dipole and that the tapering achieves an impedance matching.

10. The antenna according to claim 3, wherein the monopole is disposed on the housing, the housing contains a filter, the filter allocates signals of a high-frequency range to the dipole and signals of a low frequency range to the monopole, and the filter is connected to the line and the monopole.

11. The antenna according to claim 3, wherein the line is formed at least partially as a strip line on a substrate and the substrate is disposed at least partially in the interior of the antenna.

12. The antenna according to claim 1, wherein the monopole and the dipole are connected via a diplexer to a common contact point.

13. The antenna according to claim 1, wherein at least one part of the monopole is formed as a fold-over element.

14. The antenna according to claim 1, wherein the loading element comprises at least one ferrite core, the line is guided through the ferrite core, and an outer conductor of the line is connected to the ends of the first and second antenna elements of the monopole facing towards the loading element.

* * * * *